US012566055B2

(12) United States Patent
Bell et al.

(10) Patent No.: US 12,566,055 B2
(45) Date of Patent: Mar. 3, 2026

(54) ROLL DECOUPLING JOINT

(71) Applicants: Joshua Michael Bell, Doswell, VA (US); John Watt Fraysse, Jr., Mechanicsville, VA (US); Robert Isaac Ponder, King George, VA (US)

(72) Inventors: Joshua Michael Bell, Doswell, VA (US); John Watt Fraysse, Jr., Mechanicsville, VA (US); Robert Isaac Ponder, King George, VA (US)

(73) Assignee: United States of America, as represented by the Secretary of Navy, Arlington, VA (US)

( * ) Notice: Subject to any disclaimer, the term of this patent is extended or adjusted under 35 U.S.C. 154(b) by 5 days.

(21) Appl. No.: 18/801,999

(22) Filed: Aug. 13, 2024

(65) Prior Publication Data

US 2026/0049799 A1 Feb. 19, 2026

(51) Int. Cl.
*F42B 15/36* (2006.01)

(52) U.S. Cl.
CPC ..... *F42B 15/36* (2013.01)

(58) Field of Classification Search
CPC ..... F42B 15/36
USPC ..... 102/377
See application file for complete search history.

(56) References Cited

U.S. PATENT DOCUMENTS 2,849,955 A * 9/1958 Smathers ..... F42B 10/025 89/1.808
3,067,681 A * 12/1962 Beman ..... F42B 15/01 244/3.23
6,135,641 A * 10/2000 Smith ..... F16C 19/163 384/493
6,646,242 B2 * 11/2003 Berry ..... F42B 15/01 244/3.1
6,666,144 B1 * 12/2003 Kim ..... F42B 15/36 102/374
6,761,330 B1 * 7/2004 Bittle ..... F42B 10/26 244/3.23
8,319,163 B2 * 11/2012 Flood ..... F42B 10/26 102/501
9,453,531 B2 * 9/2016 Habibvand ..... F16C 19/548
2012/0181376 A1 * 7/2012 Flood, Jr. ..... F42B 10/64 244/3.1

(Continued)

OTHER PUBLICATIONS

D. A. Bittle et al., "Roll Isolation Bearing Design . . . " AIAA-98-5148.

*Primary Examiner* — Troy Chambers
*Assistant Examiner* — Benjamin S Gomberg
(74) *Attorney, Agent, or Firm* — Gerhard W. Thielman

(57) ABSTRACT

A roll decoupling joint is provided for connecting a rocket motor to a payload. The joint includes a payload adapter, a motor sleeve, a rotational separator and a fastener. The adapter includes an annular socket and a cylindrical core. The socket is bounded by an opening lip and a bulkhead. The payload inserts into the socket through the lip. The core extends axially from the bulkhead opposite the lip. The sleeve is annularly axi-symmetric and inserts into the motor. This sleeve is disposed adjacent to the adapter and around the core supported by the separator. The fastener secures the core to the separator. In various embodiments, the separator constitutes a pair of bearings, and the fastener is a threaded bolt.

14 Claims, 3 Drawing Sheets

(56) References Cited

U.S. PATENT DOCUMENTS

2013/0206030 A1* 8/2013 Buttolph ..... F42B 10/26
102/524

* cited by examiner

ROLL DECOUPLING JOINT

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to roll decoupling joint. In particular, the invention relates to a device to decouple axial spin between a rocket motor and a modular payload, such as induced by a launch motor to a spin sensitive delivery vehicle.

A rocket booster to launch and accelerate a payload can be spin stabilized by roll turning along the longitudinal axis for improved guidance. This condition can impart residual roll to that payload, impeding its functionality.

SUMMARY

Conventional joints for connecting rocket motors and payloads while enabling spin separation yield disadvantages addressed by various exemplary embodiments of the present invention. In particular, various exemplary embodiments provide a roll decoupling joint for connecting a rocket motor to a payload. The joint includes a payload adapter, a motor sleeve, a rotational separator and a fastener. The adapter includes an annular socket and a cylindrical core.

The socket is bounded by an opening lip and a bulkhead. The payload inserts into the socket through the lip. The core extends axially from the bulkhead opposite the lip. The sleeve is annularly axi-symmetric and inserts into the motor. This sleeve is disposed adjacent to the adapter and around the core supported by the separator. The fastener secures the core to the separator. In various embodiments, the separator constitutes a pair of bearings, and the fastener is a threaded bolt.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced.

These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The disclosure generally employs quantity units with the following abbreviations: length in meters (m) or inches ("), mass in grams (g), time in seconds (s), angles in degrees (°), force in newtons (N), temperature in kelvins (K), energy in joules (J) and frequencies in hertz (Hz). Supplemental measures can be derived from these, such as density in grams-per-cubic-centimeters ($g/cm^3$), moment of inertia in gram-square-centimeters ($kg\text{-}m^2$) and the like.

Figure 1A:
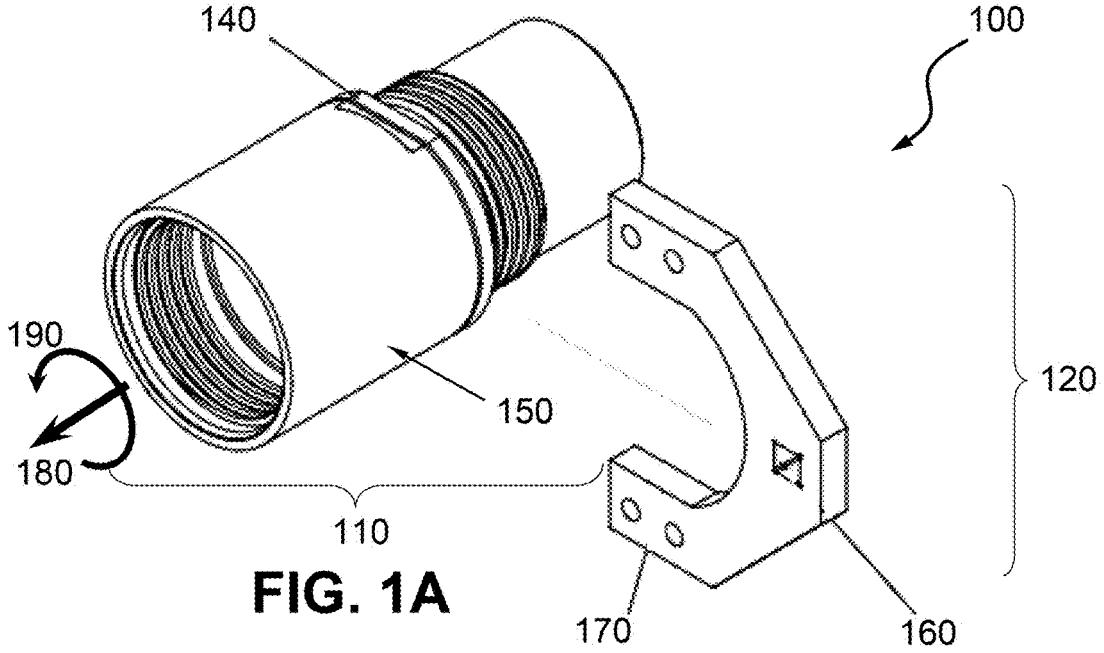
FIGS. 1A and 1B are isometric views 100 of an exemplary roll joint.
Figure 1B:
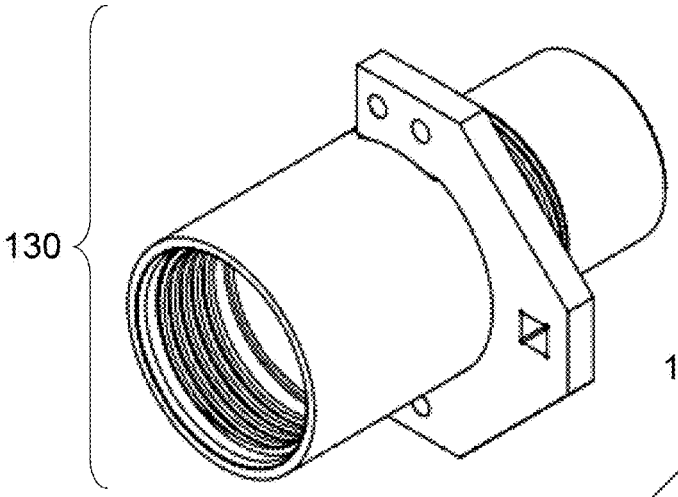

FIGS. 1A and 1B show isometric views 100 of an exemplary roll decoupling joint 110 for payload adaption that can be torqued using a spanning wrench 120 that serves as a torque applier 130. The cylindrical joint 110 includes a pair of opposing parallel grooves 140 in the outer circumference 150 of a proximal annular shaft (310 in FIG. 3) adjacent to the narrow distal motor adapter (320 in FIG. 3).

The wrench 120 constitutes a chamfered arc in shape a bridge 160 connecting to a pair of fork arms 170. The span distance between the arms 170 depends on the dimensions of the adapter's circumference 150. The joint 110 has a longitudinal axis 180 about which the wrench 120 can turn the circumference 150 can roll shown in the anti-clockwise direction 190. Typically for practical configurations such distances range from approximately two inches to one foot. The U.S. Army's unguided 2.75" diameter MK66 rockets represent an example of expected operation.

Under spin stabilization, such rockets can roll up to nearly 40 Hz in either direction. Army engineers developed a roll isolation design that employs bearings that radially divide components that roll at separate rates, in contrast to the exemplary configuration that separate such components axially, as reported by D. A. Bittle et al., "Roll Isolation Bearing Design and Testing . . . ", AIAA-98-5148, October 1998.

Figure 2:
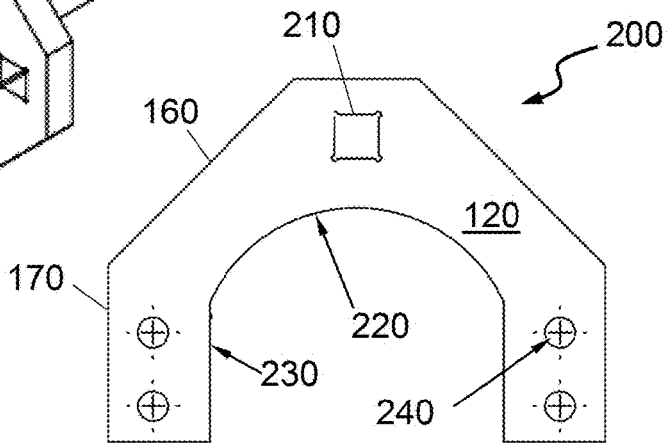
FIG. 2 is a plan view of a spanning wrench for installing the roll joint.

FIG. 2 shows a plan view 200 of the spanning wrench 120. The bridge 160 includes a square hole 210 to receive a handle standard torque wrench head (not shown). A round inner surface 220 of the bridge 160 extends between the arms 170. The surface 220 abuts the outer circumference 150 of the adapter 110. Each arm 170 forms an inner interface surface 230 that engages its corresponding groove 140. Each arm 170 also includes a pair of holes 240.

Figure 3:
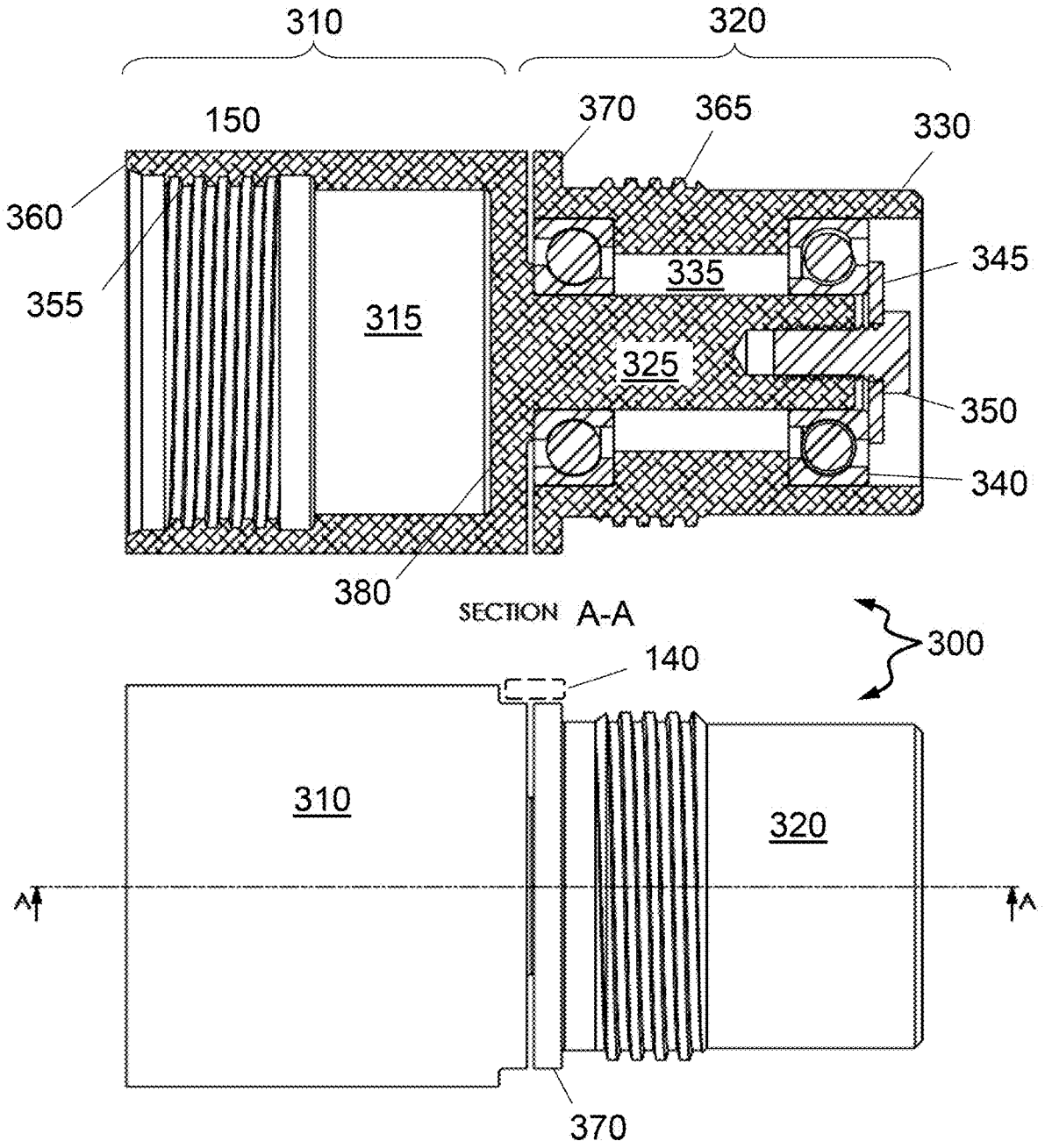
FIG. 3 is a set of elevation and cross-section views of the roll joint.

FIG. 3 shows cross-section and elevation views 300 of the roll joint 110 with the upper illustration providing the cross-section through plane A-A of the corresponding arrows in the lower illustration. The roll joint 110 constitutes an integral component subdivided by an annular payload socket 310 containing a cylindrical well 315 that couples to a motor adapter 320. A cylindrical shaft or core 325 extends axially from the socket 310 towards the adapter 320, which provides roll spin separation from the socket 310.

In relation to view 100, the proximal socket 310 and distal adapter 320 enable axial rotational decoupling between payload and motor attachments. The cylindrical well 315 resides within the circumference 150. The distal adapter 320 includes an axi-symmetric sleeve 330 within a cylindrical cavity 335 within the adapter 320 supported around the core 325 by a pair of bearings 340 that rotationally separate the core 325 and sleeve 330 from each other. Thus, the bearings 340 constitute rotational separators.

A washer 345 secured by a threaded bolt 350 axially constrains the bearings 340 at the distal end of the core 325, while the bearings 340 axially restrain the sleeve 330 to the adjacent socket 310. The bearings 340 can preferably be spherical balls or cylindrical rollers within annular races.

The cavity 315 includes female threads 355 and an inner lip 360. The sleeve 330 includes male threads 365 and a radial flange 370. The well 315 terminates in a bulkhead 380 from which the sleeve 330 axially extends opposite the lip 360. In summary, the roll decoupling joint 110 comprises a distal adapter 320 coupled to a proximal socket 310, bearings 340, a securing washer 345 and a fastening bolt 350 to enable the core 325 within the cavity 335 to rotationally decouple from the sleeve 330 while remaining securely attached.

The modular joint 110 is held together using a custom close-fit clearance washer 345 and bolt 350. The assembly can be designed such that the washer 345 bottoms out on the bearing shoulder as flange 370, enabling the bolt 350 to preload the bearings 340 as desired. Alternatively, the washer 345 can be arranged to bottom on the sleeve 330 so that the bearings 340 experience no preload, while the assembly still retains minimal axial slack. Bearing preload can be adjusted based on the load environment expected for the modular joint 110.

In terms of manufacture production as singular components, the joint 110 can be subdivided into two main components along with fastener and separation items. The first component constitutes an integral body that includes the socket 310 and the core 325. The second component denotes the sleeve 330. Separation and fastener items for assembly include the bearings 340, the washer 345 and the bolt 350.

Figure 4:
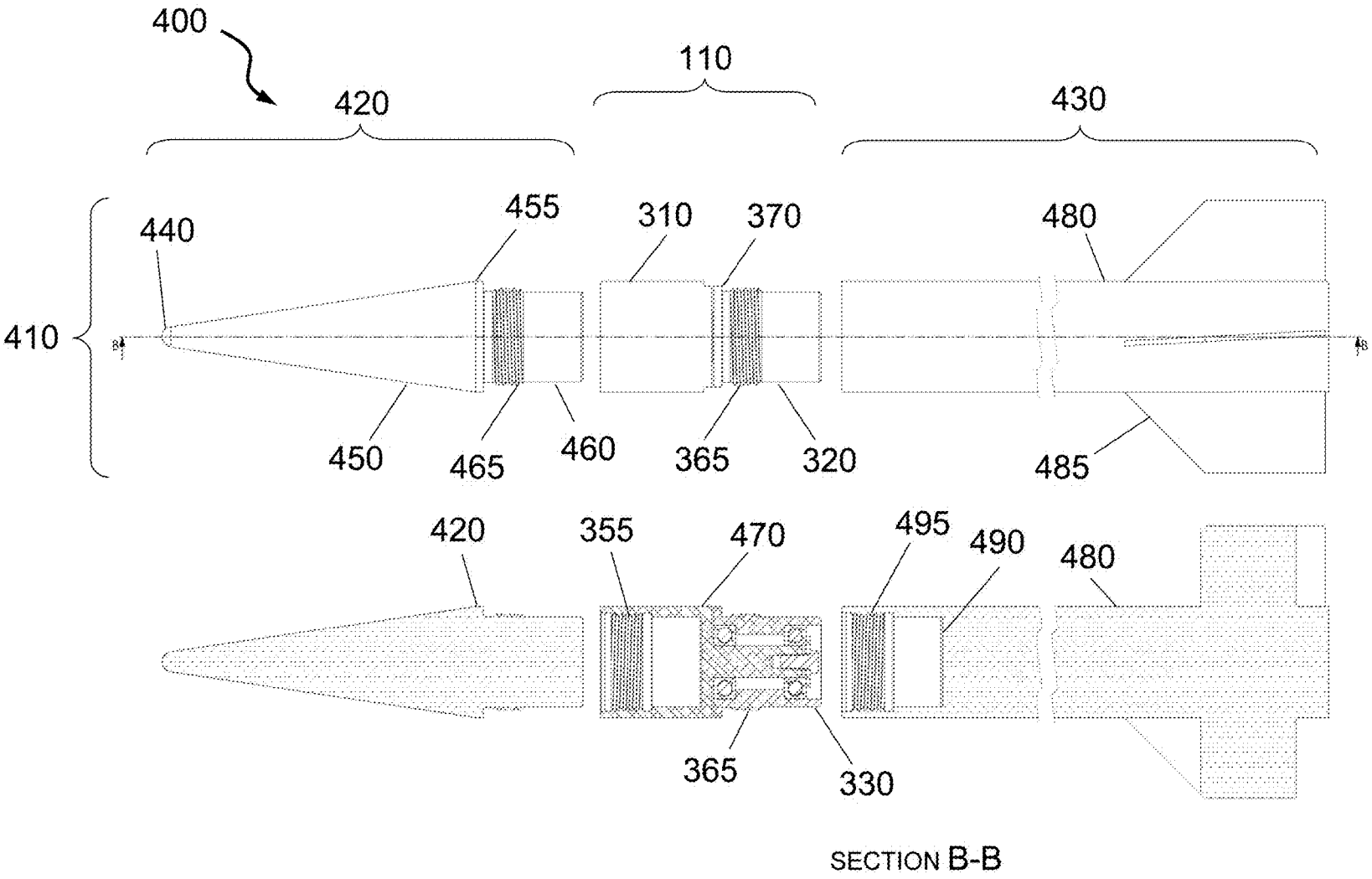
FIG. 4 is a set of exploded elevation and cross-section views of the roll joint that connects between a payload and a boost motor.

FIG. 4 shows exploded cross-section and elevation views 400 of a launch assembly 410 including a payload 420 and a rocket motor 430 for propulsion joined together by the roll joint 110. The assembly 410 with the upper illustration provides the cross-section through plane B-B of the corresponding arrows in the lower illustration. The configuration and geometry are exemplary and not limiting. As such, the exemplary joint 110 can be rescaled for larger (or smaller) missiles than the MK66.

The payload 420 includes a nose tip 440 for a conical fore-body 450 and a cylindrical shoulder 455. A cylindrical aft-body 460 with male threads 465 attaches behind the shoulder 455. The aft body 460 has a smaller outer diameter than the shoulder 455 for insertion through the lip 360 and into the well 315 of the roll joint 110. The male threads 465 of the aft body 460 engage the female threads 355 of the proximal socket 310 adjacent its lip 360.

The integral combination of the socket 310 and the core 325 can be ascribed as a payload adapter 470. For structural integrity under tension and torsion, the payload adapter 470 and sleeve 330 are preferably composed of appropriate aluminum alloy, although steel can be used for select conditions.

The boost motor 430 includes a case 480 for containing solid propellant and can be steered by vanes 485. A cylindrical cavity 490 as a blind well with female threads 495 is disposed at the forward end of the case 480. The integrated sleeve 330 inserts into the cavity 490. The male threads 365 of the sleeve 330 engage the female threads 495 of the case 480.

The displayed example is for a rocket, whose payload interface is a blind well with female threads 355 at near the lip 360 of the well. The motor adapter 320 is designed to interface with the threads 375 and bottom out on the outer lip 360 of the well 315. The payload socket 310 provides this well as cavity 315 so that the modular joint 110 can interface directly between standard pairs of payload 420 and motor 320. This design can be modified to be implemented for a coupling joint 110 that relies on a different sized well 315 or a radial bolt pattern to lock the joint 110.

For threaded payload-to-motor joints 110, the wrench 120 may be needed to both lock the modular joint 110, as well as provide appropriate torque to the payload 420 and motor 430. This is accomplished by incorporating flat grooves 140 straddling the bearing joint gap. The spanning wrench 120 with flat arms 170 can be used to interface with the mating grooves 150 on the modular joint 110. The spanning wrench 120 can attach to standard square torque wrench drives to ensure proper torque being applied.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A roll decoupling joint for connecting a rocket motor to a payload, said joint comprising:

a payload adapter having an annular socket and a cylindrical core, said socket bounded by an opening lip and a bulkhead, said core extending axially from said bulkhead, the payload inserting into said socket through said lip;

an axisymmetric motor sleeve being disposed axially adjacent to said socket and around said core;

a rotational separator that supports said sleeve around said core; and a fastener that secures said core to said separator, wherein said sleeve inserts into the motor, and said bulkhead and said sleeve share a pair of parallel grooves for torque application.

2. The joint according to claim 1, wherein said rotational separator is a pair of bearings at fore and aft ends of said core.

3. The joint according to claim 1, wherein a washer interposes between said fastener and said separator.

4. The joint according to claim 3, wherein said washer enables said separator to impinge against said sleeve for avoiding preload to said separator.

5. The joint according to claim 1, wherein said fastener is a threaded bolt.

6. The joint according to claim 1, wherein said socket includes female threads that secure counterpart male threads of the payload.

7. The joint according to claim 1, wherein said sleeve includes male threads that secure counterpart female threads of the motor.

8. The joint according to claim 1, wherein a spanning wrench having a parallel yoke joined to a bridge provides said torque application.

9. The joint according to claim 8, wherein said bridge includes a square hole for attachment to a torque wrench.

10. The joint according to claim 1, wherein said torque application locks said adapter and said sleeve together following respective installation to the payload and the motor.

11. The joint according to claim 1, wherein said sleeve further includes an annular flange that extends radially therefrom and adjacent said bulkhead for sharing said pair of parallel grooves.

12. The joint according to claim 11, wherein a washer interposes between said fastener and said separator.

13. The joint according to claim 12, wherein said washer enables said separators separator to impinge against said flange for providing preload to said separator.

14. The joint according to claim 1, wherein said adapter and said sleeve are composed of aluminum alloy.

* * * * *